United States Patent [19]

Fricke et al.

[11] 4,018,137

[45] Apr. 19, 1977

[54] PISTON MACHINE CONSTRUCTION

[75] Inventors: Hans-Jürgen Fricke, Stuttgart; Gerhard Nonnenmacher, Korntal; Walter Robeller, Boblingen; Günter Kersten, Stuttgart, all of Germany

[73] Assignee: Robert Bosch G.m.b.H., Stuttgart, Germany

[22] Filed: Sept. 4, 1975

[21] Appl. No.: 610,402

Related U.S. Application Data

[62] Division of Ser. No. 432,742, Jan. 11, 1974, Pat. No. 3,948,149.

[30] Foreign Application Priority Data

Feb. 17, 1973 Germany ..... 2307997

[52] U.S. Cl. ..... 91/488

[51] Int. Cl.[2] ..... F01B 13/06

[58] Field of Search ..... 91/488, 491, 498

[56] References Cited

UNITED STATES PATENTS

| | | | |
|---|---|---|---|
| 3,223,046 | 12/1965 | Eickmann | 91/488 |
| 3,628,425 | 12/1971 | Morita | 91/488 |
| 3,793,826 | 2/1974 | Smith | 91/488 |
| 3,943,826 | 3/1976 | Kyoto | 91/488 |

OTHER PUBLICATIONS

Oil Hydraulic Power and Its Industrial Application, published by McGraw-Hill Book Company, 1960, pp. 118 and 119.

*Primary Examiner*—William L. Freeh
*Attorney, Agent, or Firm*—Michael J. Striker

[57] ABSTRACT

In a piston machine of the type having a housing, a reciprocable piston in the housing and provided with an axial end portion and a piston-reciprocating element having a glide surface located opposite and movable with reference to the end portion for effecting the reciprocation of the piston, the invention provides for a glide shoe which is articulately connected to the end portion of the piston and which has a glide face in gliding contact with the glide surface of the piston-reciprocating element. The glide face has a recess which communicates via a passage with a source of pressure fluid, a sealing rim of substantially constant width surrounding the recess, and a plurality of face portions which are located outwardly of the sealing rim and configurated so that hydrodynamic pressure fields develop between the face portions and the respectively juxtaposed surface portions of the glide surface.

9 Claims, 14 Drawing Figures

PISTON MACHINE CONSTRUCTION

This is a division of application Ser. No. 432,742, filed Jan. 11, 1974, now U.S. Pat. No. 3,948,149.

BACKGROUND OF THE INVENTION

The present invention relates generally to a piston machine, and more particularly to a piston machine wherein a piston is connected with a piston-reciprocating element by a glide shoe articulated to the piston and in gliding contact with a glide surface of the piston-reciprocating element.

Piston machines are known of the type having a housing, a reciprocable piston in the housing, and provided with an axial end portion, and a piston-reciprocating element having a glide surface located opposite to and movable with reference to the end portion of the piston for effecting reciprocation of the latter. It is also known to provide a glide shoe which is connected with the axial end portion of the piston and has a glide face which is in gliding contact with the glide surface of the piston-reciprocating element. Such arrangements are known both in axial piston machines and in radial piston machines, the present invention being particularly concerned with the latter type. Such a radial piston machine is disclosed e.g. in the U.S. Pat. No. 3,663,125.

It is known to construct the glide shoe with an annular recess in its glide face, the recess being surrounded by a relatively broad sealing rim, and the glide face being further provided on its corners with approximately triangular supporting face portions. This prior-art construction assures, due to the presence of the broad sealing rim, that there will be low leakage losses of fluid and that the glide face will be relatively resistant to wear. However, this construction has the disadvantage that the hydrostatic relief of the glide shoe is relatively poor because the supporting face portions are too small to allow the development of significant hydrodynamic pressure fields between themselves and the juxtaposed glide surface of the piston-reciprocating element. This means that this type of glide shoe is not useable for radial piston machines which are operated at high pressures or at high speeds of revolution.

SUMMARY OF THE INVENTION

Accordingly, it is a general object of the present invention to overcome the disadvantages of the prior art.

More particularly, it is an object of the present invention to provide, in a piston machine of the type under discussion, an improved glide shoe which is relieved both hydrostatically and hydrodynamically, and which is therefore particularly well suited for piston machines operating at high rotary speeds or at high pressures.

In keeping with the above objects, and with others which will become apparent hereafter, one feature of the invention resides in a piston machine of the type having a housing, a reciprocable piston in the housing and having an axial end portion, and a piston-reciprocating element having a glide surface located opposite and movable with reference to the end portion for effecting the reciprocation of the piston, in a combination which comprises a glide shoe articulately connected to the end portion of the piston and having a glide face in gliding contact with the glide surface. The glide face has a recess which communicates via a passage with a source of pressure fluid, a sealing rim of substantially constant width surrounding the recess, and a plurality of face portions which are located outwardly of the sealing rim and are configurated so that hydrodynamic pressure fields develop between the face portions and the respectively juxtaposed surface portions of the glide surface.

The supporting capability of the hydrodynamic pressure fields depends upon the rotary speed of the machine, so that if the speed of rotation varies, an excellent accommodation is obtained to the forces which are to be absorbed by the glide shoe and which vary with the variations in the speed of rotation.

It is particularly advantageous if the recess is in form of a rectangle the longitudinal sides of which extend normal to the direction of relative movement between glide shoe and piston-reciprocating element, and if it is located between two grooves which extend transverse to the direction of movement and intersect the edges of the glide face which extend in the direction of relative movement. With such a construction rectangular glide face portions are provided at the opposite ends of the glide face which have longitudinal sides that extend transversely to the direction of movement. In such a construction the bending stress upon the glide face is low because the hydrodynamic pressure field extends transversely to the elongation of the glide face.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
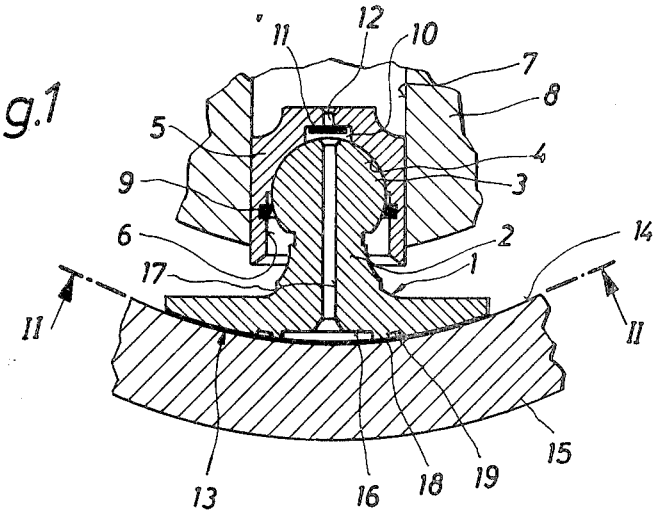
FIG. 1 is a fragmentary axial section through a piston, glide shoe and piston-reciprocating element in a machine of the type according to the present invention.
Figure 2:
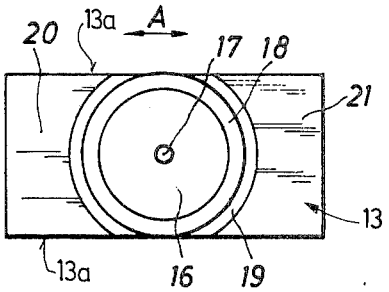
FIG. 2 is a bottom plan view of the glide face on the shoe in FIG. 1, as seen from the line II—II.

Discussing firstly the embodiment in FIGS. 1 and 2, it will be seen that reference numeral 1 identifies a glide shoe having a shaft 2 which is provided with a spherical head 3. The latter is received in a spherical socket 4 formed in a stepped bore 6 which extends axially through a piston 5. The invention is being described with reference to a rotary piston machine, such machines being already well known to those skilled in the art. The piston 5 is reciprocably accommodated in a bore 7 formed in a cylinder body 8. A spring ring or circlip 9 is provided to maintain the glide shoe 1 on the piston 5 as shown.

A cylindrical portion 10 of the stepped bore 6 is located above or inwardly of the head 3 and accommodates a valve plate 11 which can close a throttling gap 12 forming a part of the bore 6, with which throttling gap 12 the valve plate 11 forms a non-return valve.

The glide shoe 1 has a glide face 13 which is in gliding contact with a glide surface 14 of a piston-reciprocating element 15 of the radial piston machine, that is an element which resembles in its function the swash plate of an axial piston machine. The element 15 is accommodated in the interior of the housing that is not illustrated because it is well known in the art.

FIG. 2 shows details of the configuration of the glide face 13. It will be seen that the latter is provided with a circular recess 16 into which a bore 17 opens which is formed in the shaft 2, so that pressure fluid can enter the recess 16 through the bore 17 from the cylinder bore 7. The bore 17 communicates with the cylindrical portion 10 of the stepped bore 6, and from there it communicates with the cylinder bore 7 via the throttling gap 12. The recess 16 is surrounded by an annular sealing ring 18, the outer diameter of which corresponds to the transverse width of the glide face 13. The term transverse width refers to the dimension of the glide face 13 in direction normal to the relative movement between the shoe 1 and the element 15, which relative movement is identified with the double-headed arrow A in FIG. 2. It is appropriate at this point to state that the same direction of movement is identified in the remaining Figures by the double-headed arrow A if the direction of movement between glide shoe 1 and element 15 can be reversed, whereas a single-headed arrow B is used if the movement between glide shoe 1 and element 15 can be in only one direction. By the same token, the longitudinal direction of the glide shoe 1 refers of course to the dimension of the glide shoe 1 in the direction of the arrows A or B in all Figures.

The sealing rim 18, which is of substantially constant width, is surrounded by an annular groove 19 which is evidently of larger diameter than the rim 18 and which thus intersects the longitudinally extending edges 13*a* of the glide face 13. At the opposite ends of the glide face 13 as seen with respect to the direction of movement A, there are provided glide surface portions 20, 21 which extend over the entire transverse width of the surface 13 and in longitudinal direction of the glide surface 13 are delimited by respective opposite ends of the glide surface on the one hand, and the grooves 19 on the other hand.

The forces exerted by the piston 5 upon the glide shoe 1 are compensated for by the hydrostatic pressure field which develops as the result of the inflow of pressure medium through the bore 17 in and above the recess 16, that is between the recess 16 and the corresponding portion of the glide surface 14 of the element 15, and also by the hydrodynamic pressure fields which develop during the movement of the glide shoe between the glide surface portions 20, 21 and the respectively juxtaposed portions of the surface 14. The provision of the groove 19 assures an exact positioning of the hydrodynamic pressure field which develops in the recess 16, and the symmetrical arrangement of the glide face portions 20, 21 makes this particular glide shoe 1 suitable for movement in two opposite directions, as indicated by the double-headed arrow A.

The provision of the valve 11, 12 assures that pressure medium can flow into the recess 16, but prevents the flow of pressure medium from the interior of the housing via the recess 16 and the bore 17 into the cylinder bore 7 in the event that the pressure in the hydrodynamic pressure field opposite the face portion 20 or 21 is greater than the pressure in the cylinder bore 7. The groove 19 operates in the same sense, because pressure medium which during relative movement of the surfaces 13 and 14 is drawn into the gap between the surface 14 and the face portions 20 and 21, is largely guided back into the interior of the housing along the longitudinal edges 13*a* where it escapes from the groove 19.

This particular glide surface with its various recesses and face portions can be produced very readily, for instance by milling, casting or flow-molding, and the fact that the recess 16 is circular reduces the susceptibility of the face 13 to interference from accumulating contaminants.

Figure 3:
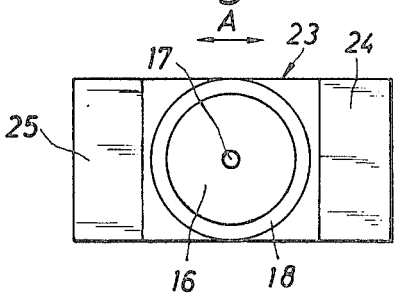
FIGS. 3–14 are all views similar to FIG. 2 but illustrating further embodiments of the invention.

In FIG. 3 we have shown a glide face 23. In this Figure, as in FIGS. 4–14, it should be understood that the basic construction corresponds to that shown in FIG. 1, except that the glide surface in each instance differs from that in FIGS. 1 and 2.

The glide face 23 in FIG. 3, wherein like reference numerals identify like components as before, is provided at the opposite ends with surface portions 24, 25, having the form of respective rectangles the longitudinal sides of which extend normal to the direction of movement A. In other respects the embodiment of FIG. 3 corresponds to that of FIG. 2, and in operation it will also behave approximately in the same manner as that of FIG. 2.

Figure 4:
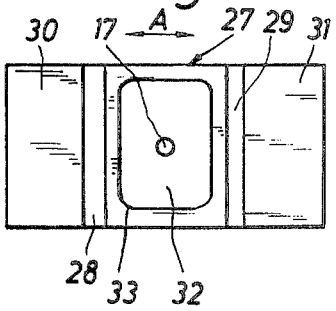

FIG. 4 shows an embodiment wherein the glide face 27 is provided with two grooves 28, 29 extending normal to the direction A and being arranged symmetrically with respect to the center of the glide face. They delimit glide face portions 30, 31 located at the opposite ends of the glide face 27 and being of rectangular outline, the longitudinal side of the respective rectangle extending transverse to the direction A. A rectangular recess 32 is here provided instead of the circular recess 16 of FIGS. 2 and 3, and is surrounded by a similarly rectangular sealing rim 33 of approximately constant width. The inner corners of the recess 32 are rounded, and the elongation of the rectangle formed by the recess 32 extends transversely to the direction A.

In this embodiment, the forces acting upon the glide shoe having the glide face 27, are absorbed by the hydrostatic pressure field which develops in the recess 32, and the hydrodynamic pressure fields which develop during the relative movement of glide shoe and element 15 between the glide face portions 30, 31 and corresponding surface portions of the glide surface 14. The grooves 28 and 29 delimit the hydrodynamic pressure fields which develop opposite the face portions 30, 31 and at the same time prevent pressure fluid from being dragged during gliding movement into the region of the recess 32, a feature which is important because it would adversely influence the precalculated relationship of forces which act upon the glide face 27. The rounding of the corners of the recess 32 reduces the danger that groove might be worn in the glide face 27 due to the presence of contaminants which otherwise would be deposited in those corners. The symmetrical arrangement of the face portions 30, 31 makes the glide shoe suitable again for movements in two opposite directions, as indicated by the arrow A. Because the hydrodynamic pressure field in the recess 32 extends transversely to the elongation of the glide face 27, the bending stresses acting upon the glide shoe having the face 27 are reduced.

Figure 5:
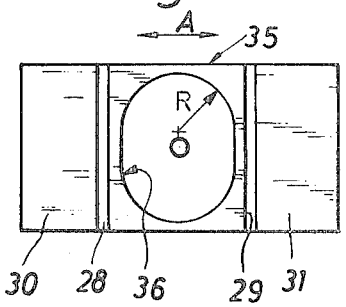

FIG. 5 shows an embodiment wherein the glide face identified with reference numeral 35 is provided with a recess 36 of approximately oval configuration. The longitudinal sides of this recess extend transversely to the direction of the arrow A and are connected by semi-circles having the radius R. In other respects the embodiment of FIG. 5 corresponds to that of FIG. 4 and the same reference numerals are used to designate like elements. The oval configuration of the recess 36 makes the glide face 35 particularly resistant to the formation of grooves due to the presence of contaminants. In operation and in characteristics the embodiment of FIG. 5 corresponds to that of FIG. 4.

Figure 6:
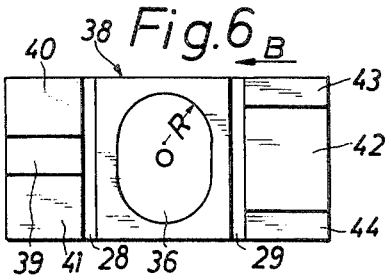

FIG. 6 shows an embodiment wherein the glide face 38 is intended for only movement in one direction, namely the direction indicated by the arrow B. Hence, the left-hand transverse edge of the glide face 38 is the leading edge, and the right-hand transverse edge is the trailing edge. In the region of the leading edge, the glide face 38 is subdivided by a longitudinally extending groove 39 into two face portions 40, 41, whereas in the region of the trailing edge, the face 38 is again subdivided by a longitudinally extending groove 42 into two face portions 43, 44. However, the groove 42 is substantially wider in transverse direction than the groove 39, so that the face portions 43, 44 are substantially narrower than the face portions 40, 41. The face portions 40, 41, 43 and 44 are all rectangles, the longitudinal sides of which, that is the major dimension of which, extends in the direction of the arrow B. In other respects, the embodiment of FIG. 6 corresponds to the embodiment of FIG. 5, and the recess being oval, and the grooves 28 and 29 being provided as in FIG. 5, with these grooves communicating with the recesses or grooves 39 and 42, respectively.

Because the hydrodynamically effective face portions 40, 41 at the leading edge region of the face 38 are larger than the face portions 43, 44, the relief is greater at the leading end region and the region of the narrowest gap between the glide face 38 and the glide surface 14 moves towards the rear or trailing edge, so that the glide shoe will lift off the glide surface 14 more strongly in the region of its leading edge with the result that the hydrodynamic supporting force and thereby the relief effect will be further improved.

The construction of FIGS. 2–4 can be modified analogously to the embodiment of FIG. 6, in that the glide surfaces 20, 21, 24, 25 and 30, 31 are subdivided by grooves corresponding to the grooves 39, 42 of FIG. 6. In that case the effect would be approximately the same as in the embodiment of FIG. 6.

Figure 7:
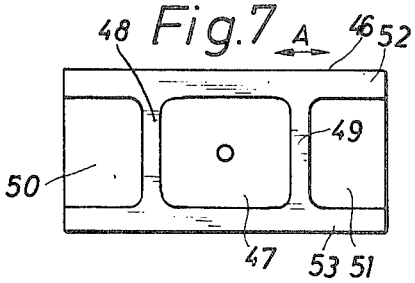

FIG. 7 shows a glide face 46 wherein the recess located at the center of the glide face is approximately quadratic and is identified with reference numeral 17. Separated from the recess 47 by surface portions 48, 49 which are substantially strip-shaped and form a part of the sealing rim, there are provided rectangular recesses 50, 51 each of which extends from one of the ends (the leading end and the trailing end, respectively) to the respective surface portions 48, 49. The major dimension of each of the recesses 50, 51 extends transversely to the direction of movement A and their lengths corresponds to the length in the same direction of the recess 47. The recesses 5, 51 are each open over their entire length to the leading and trailing end, respectively, so that they communicate with the interior of the housing which was mentioned earlier. The corners of the recesses 47, 50 and 51 are rounded for the reasons which have been previously discussed, and the longitudinal edges of the glide face 46, that is the edges which extend parallel to the direction A, are formed with surface portions 52, 53, which are strip-shaped and extend over the entire length of the glide face 46, in part constituting the rim surrounding the recess 47, in conjunction with the surface portions 48 and 49. The width of the surface portions 52, 53 is substantially constant.

In this embodiment, the recesses 50, 51 reduce the dimensions of the glide face portions so that, while sufficient hydrodynamic supporting force is retained, the losses resulting from viscous friction over the respective glide face portions are reduced. The necessary hydrodynamic relief is obtained by the hydrodynamic pressure fields which develop between the surface portions 52, 53 and the corresponding surface portions of the surface 14. This configuration is particularly suitable for machines which operate at high rotary speed.

Figure 8:
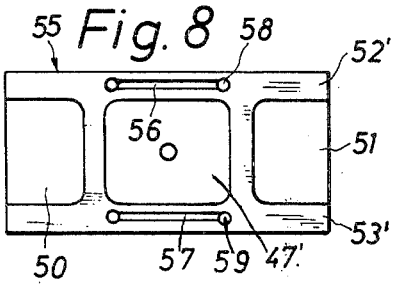

FIG. 8 shows an embodiment which is a modification of the embodiment shown in FIG. 7, like reference numerals again identifying like elements, except that here the face portions 52, 53 are replaced with face portions 52′, 53′. The face portions 52′, 53′ extend at opposite sides of the recess 47′ and are each formed with a longitudinal slot 56, 57, respectively, which extend parallel to the adjacent edges of the recess 47′ and have the same length as these edges. These slots 56, 57 are in communication with the interior of the housing via respective bores 58, 59.

In this embodiment, the slots 56, 57 serve to provide an exact delimitation of the hydrostatic pressure field which develops in the recess 47′, that is a delimitation along the sides of the recess 47′ which are adjacent the slots 56, and 57. In other respects, this embodiment corresponds to the embodiment of FIG. 7.

Figure 9:
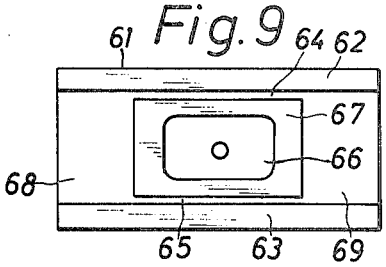

FIG. 9 shows a glide face 61 wherein the longitudinal edges extending in the direction of movement are formed with surface portions 62, 63 which are strip-shaped and extend over the entire length of the glide face 61. Intermediate the surface portion 62, 63 and separated from the same by respective longitudinally extending grooves 64, 65, is provided a rectangular sealing rim 67 which surrounds a rectangular recess 66. The inner corners of the recess 66 are rounded for the reasons discussed earlier, and the length of the recess 66 in parallelism with the surface portion 62, 63 is substantially shorter than the length of the surface portions 62, 63. At the opposite ends of the glide face 61, intermediate these ends and the rim 67, there are formed recesses 68, 69 which communicate with the grooves 64, 65 and also with the interior of the housing.

The grooves 64, 65 delimit the hydrostatic pressure field in the recess 67 along the surface portions 62, 63. Hydrodynamic pressure fields develop over the surface portions 62, 63, and the surface area of these surface portions is so selected that the viscous friction losses are small, but that on the other hand, the desired relief of the glide shoe is obtained.

Figure 10:
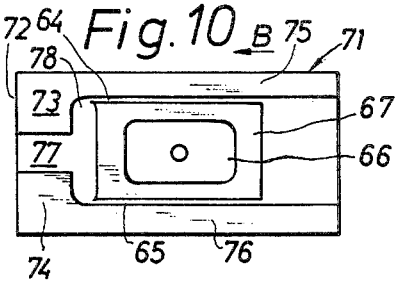

FIG. 10 shows an embodiment which is somewhat reminiscent of FIG. 9 and is intended for direction of movement in direction of B only. The glide surface is here identified with reference numeral 71 and the leading edge 72 of the glide face 71 is provided with glide face portions 73, 74 which merge into strip-shaped surface portions 75, 76. The face portions 73, 74 are separated from one another by a groove 77 extending in direction of the arrow B, and they are separated from the sealing rim 67 surrounding the recess 66 by a transverse groove 78 which merges with the groove 77 as well as with the grooves 64 and 65, that have been described with reference to FIG. 9.

In this embodiment, the glide face portions 73, 74 cause an increase of the hydrodynamic pressure field in the region of the leading end 72, so that in this region the glide shoe will be lifted off the surface 14 more strongly, thus obtaining an improvement in the hydrodynamic relief of the glide shoe. This makes the glide shoe particularly suitable for machines which operate at high rotary speeds and at high pressures.

The embodiments of FIGS. 7 and 8 could be modified analogously to the embodiment of FIG. 10, in which case the effect in these embodiments would be the same as that obtained in FIG. 10.

Figure 11:
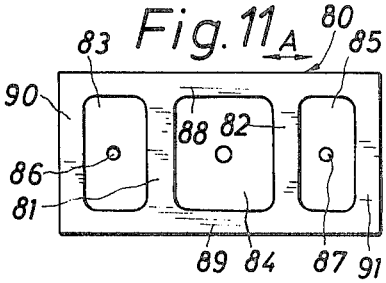

FIG. 11 shows a glide face 80 which is formed by three parallel recesses 83, 84 and 85 which are each of rectangular configuration. They are located one behind the other with respect to the direction of movement A and their major dimension extends transversely to this direction of movement. The length of the major dimension of each of the recesses 83, 84 and 85 is identical and the corners of the recesses are all rounded. In the direction A the size of the center recess 84 is substantially greater than that of the recesses 83, 85, the latter being connected by relief bores 86, 87, with the interior of the housing. Substantially strip-shaped surface portions 88, 89 extend along the longitudinal edges of the glide face 80 in parallelism with the direction A, and over the entire length of the glide face 80. Portions of these surface portions 88, 89 form, together with transversely extending portions 81 and 82, the sealing rim which surrounds the recess 84. The recesses 83 and 85 are separated from the leading and trailing ends (the definition of these ends is interchangeable, depending on the direction of movement) by strip-shaped face portions 90, 91, respectively.

The arrangement of the recesses 83, 85 reduces the glide face portions and thereby the friction. Hydrodynamic pressure fields for relief of the glide shoe can develop over the face portions 88, 89 and this makes this glide shoe particularly suitable for machines which operate at high revolutions. The hydrodynamic relief of the glide shoe results from the pressure field which develops in the recess 84.

Figure 12:
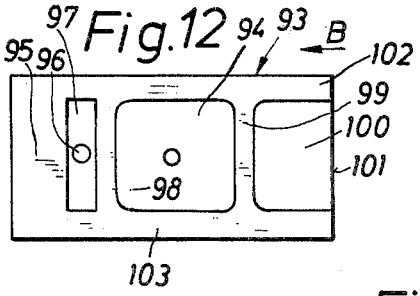

FIG. 12 shows an embodiment wherein the glide face 93 is provided at its center with a rectangular recess 94 the longitudinal sides of which extend in parallelism with the direction of movement indicated by the arrow B. The corners are again rounded. At the leading end of the glide face 93 the latter is provided with glide face portion 95 of rectangular outline, the major dimension of which extends transverse to the direction B. The glide face portion 95 is provided with a slot-shaped groove or recess 97 which communicates via a relief bore 96 with the interior of the housing, and is separated from the recess 94 by a face portion 98. The length of the groove 97 corresponds to the dimension of the recess 94 in direction normal to the direction B. In the region of the trailing end, the glide face 93 is provided with a recess 100 which is separated from the recess 94 by a sealing portion 99. The recess 100 is rectangular and has a major dimension transversely to the direction B, being open over this entire major dimension to the interior of the housing in that it intersects the trailing end 101. Face portions 102 and 103 merge with the face portion 95.

This embodiment is particularly suitable for glide shoes used in machines with a uniform direction of rotation, as indicated by the arrow B. The glide face 95 causes the development of the hydrodynamic pressure field which relieves the glide shoe, and the groove 97 prevents the pressure fluid from being dragged out of this hydrodynamic pressure field into the recess 94, because this would disadvantageously influence the pressure distribution and the force relationships acting on the glide shoe. The recess 100 supplements and increases the effect of the glide face portion 95, in a sense assuring that particular hydrodynamic relief becomes available at the leading end for the glide shoe. Furthermore, the provision of the recess 100 in the region where the gap between the glide face 93 and the glide surface 14 is narrowest, causes a reduction in the viscous friction.

Figure 13:
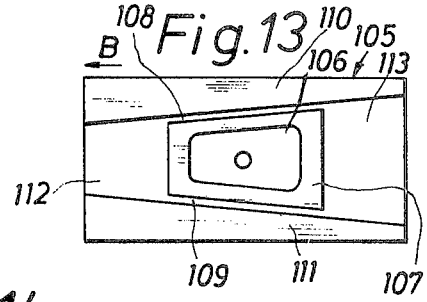

The glide face 105 in the embodiment of FIG. 13 is formed with a centered recess 106 having the form of a trapezoid the large side of which, as seen in the direction of movement indicated by the arrow B, is the trailing side. The length of the recess 106 is substantially smaller than the length of the glide face 105, and the recess is surrounded by a sealing rim 107 which is separated by grooves 108, 109 from glide face portions 110, 111 which extend in the direction indicated by the arrow B along the longitudinal edges of the glide face. These face portions 110, 111 extend over the entire length of the glide face 105 and each have the form of a trapezoid the larger side of which, as seen in the direction of the arrow B, is located at the leading end of the glide face. This construction is provided with the recesses 112 and 113, which communicate with the interior of the housing.

The hydrostatic pressure field which develops in the recess 106 compensates for a part of the forces which act on the glide shoe. The configuration of the face portions 110, 111 assures that at the leading ends (the left-hand ends in FIG. 13) thereof, they develop two hydrodynamic pressure fields which further relieve the glide shoe so that the latter is particularly suitable for a machine wherein the direction of rotation is unchanging and wherein the machine operates at high revolutions, because the glide face portions and therefore the frictional losses are relatively small.

Figure 14:
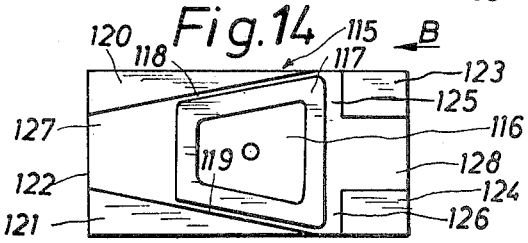

Coming, finally to the embodiment illustrated in FIG. 14, it will be seen that the glide face 115 illustrated therein is provided with a centered recess 116 of trapezoidal configuration. The large side of the trapezoid, as seen with reference to the direction indicated by the arrow B, is the trailing side. The recess 116 is surrounded by a sealing rim 117 which is separated by grooves 118, 119 from glide face portions 120, 121 which each are substantially of triangular configuration, but the base of each triangle being located at the leading end 122 of the glide face 115. At the trailing end of the glide face there are provided two rectangular glide face portions 123, 124 which act as supporting faces and which are separated from the sealing rim 117 by two transversely extending grooves 125, 126, respectively. The major dimension of the face portions 123, 124 extend parallel to the direction indicated by the narrow B. The length of the recess 116 is substantially less than the overall length of the glide face 115, so that a recess 128 is located between the rim 117 and the trailing end of the glide face and a similar recess 127 is located between the rim 117 and the leading end 122 of the glide face 115. The recesses 127, 128 each are open to and communicate with the housing.

In this embodiment a hydrostatic pressure field develops in the recess 116 and partially relieves the forces acting upon the glide shoe. Further, hydrodynamic pressure fields develop over the face portions 120, 121 and further relieve the forces acting upon the glide shoe. Because of the small length of the face portions 123, 124 only insignificant hydrodynamic pressure fields can develop over these face portions, which means that the glide shoe is more strongly relieved at the region of its leading edge 122. Grooves 118, 119 prevent pressure fluid from being pulled or dragged into the recess 118 during the movement of the glide shoe and out of the hydrodyanmic pressure fields which develop over the face portions 120, 121, so that an undesired interference with the pre-computed force relationships is avoided.

It will be understood that each of the elements described above, or two or more together, may also find a useful application in other types of constructions differing from the types described above.

While the invention has been illustrated and described as embodied in a glide shoe for a radial piston machine, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. In a radial piston machine of the type having a housing, a reciprocable piston in said housing and having an axial end portion, and a piston-reciprocatng element having a glide surface located opposite said end portion with one of said elements and piston being movable relative to the other in a manner resulting in the reciprocation of said piston, a combination comprising a glide shoe articulately connected to said end portion of said piston and having a glide face in gliding contact with said glide surface, said glide face being of substantially rectangular outline and having two spaced longitudinal edges and two spaced transverse edges which extend from one to the other of said longitudinal edges, said glide face being formed with a polygonal recess which communicates via a passage with a source of pressure fluid, a sealing rim of substantially constant width surrounding said recess, and a plurality of face portions which are located outwardly of said sealing rim and configurated so that hydrodynamic pressure fields develop between said face portions and the respectively juxtaposed surface portions of said glide surface, said glide face being further provided with a pair of additional recesses each extending from one of said transverse edges inwardly towards said recess, and said glide face having two strip-shaped wider surface portions each extending along the entire length of one of said longitudinal edges, and two strip-shaped narrower surface portions each extending from one to the other of said wider surface portions intermediate said recess and one of said additional recesses, said rim being constituted by said narrower surface portions and by parts of said wider surface portions.

2. In a radial pistion machine as defined in claim 1, wherein said recess is of substantially quadratic outline.

3. A combination as defined in claim 1, wherein said additional recesses are rectangular.

4. A combination as defined in claim 1; and further comprising a pair of slot-shaped grooves, each formed in one of said wider surface portions in parallelism with said longitudinal edges and communicating via a respective bore with the interior of said housing.

5. In a radial piston machine of the type having a housing, a reciprocable piston in said housing and having an axial end portion, and a piston-reciprocatng element having a glide surface located opposite said end portion with one of said elements and piston being movable relative to the other in a manner resulting in the reciprocation of said piston, a combination comprising a glide shoe articulately connected to said end portion of said piston and having a glide face in gliding contact with said glide surface, said glide face being of substantially rectangular outline and having two spaced longitudinal edges and two spaced transverse edges which extend from one to the other of said longitudinal edges, and of which one is a leading and the other is a trailing edge with reference to the direction of relative movement of said shoe and said element, said glide face being formed with a polygonal recess which communicates via a passage with a source of pressure fluid, a sealing rim of substantially constant width surrounding said recess, and a plurality of face portions which are located outwardly of said sealing rim and configurated so that hydrodynamic pressure fields develop between said face portions and the respectively juxtaposed surface portions of said glide surface; a pair of strip-shaped surface portions extending on said glide face along the entire length of a respective one of said longitudinal edges inwardly of the same; a first groove extending from one of said strip-shaped surface portions to the other intermediate said rim and said leading edge; and a second groove extending inwardly from said leading edge and merging with said first groove.

6. A combination as defined in claim 5, wherein said second groove is located midway between said strip-shaped surface portions.

7. In a radial piston machine of the type having a housing, a reciprocable piston in said housing and having an axial end portion, and a piston-reciprocating element having a glide surface located opposite said end portion with one of said elements and piston being movable relative to the other in a manner resulting in the reciprocation of said piston, a combination comprising a glide shoe articulately connected to said end portion of said piston and having a glide face in gliding contact with said glide surface, said glide face being of substantially rectangular outline and having two spaced longitudinal edges and two spaced transverse edges which extend from one to the other of said longitudinal edges, said glide face being formed with a rectangular recess which communicates via a passage with a source of pressure fluid, a sealing rim of substantially constant width surrounding said recess, and a plurality of face portions which are located outwardly of said sealing rim and configurated so that hydrodynamic pressure fields develop between said face portions and the respectively juxtaposed surface portions of said glide surface, one of said transverse edges being a leading edge and the other transverse edge being a trailing edge with reference to the relative movement of said shoe and said element; and said glide face further comprising an additional rectangular recess which extends from said trailing edge inwardly to said rim, and with a groove located intermediate said rim and said leading edge and extending parallel to said leading edge; said surface portions being elongated strip-shaped surface portions each of which extends inwardly along the entire length of a respective one of said longitudinal edges and in part forms said rim, and a surface portion which is located intermediate said groove and said leading edge and has in direction normal to said groove and leading edge a dimension which is smaller than its dimension in direction parallel to them.

8. In a radial piston machine of the type having a housing, a reciprocable piston in said housing and having an axial end portion, and a piston-reciprocating element having a glide surface located opposite said end portion with one of said elements and piston being movable relative to the other in a manner resulting in the reciprocation of said piston, a combination comprising a glide shoe articulately connected to said end portion of said piston and having a glide face in gliding contact with said glide surface, said glide face being of substantially rectangular outline and having two spaced longitudinal edges and two spaced transverse edges which extend from one to the other of said longitudinal edges, said glide face being formed with a recess which communicates via a passage with a source of pressure fluid, a sealing rim of substantially constant width surrounding said recess, and a plurality of face portions which are located outwardly of said sealing rim and configurated so that hydrodynamic pressure fields develop between said face portions and the respectively juxtaposed surface portions of said glide surface, said recess and said rim being of substantially trapezoidal outline and being centered on the center of said glide face, the narrow end of the trapezoid facing one of said transverse edges which is a leading edge with respect to the relative movement of said shoe and element; said face portions extending inwardly along the entire length of said longitudinal edges and being separated from said rim by respective grooves which also extend along the longitudinal edges, said face portions each also having the shape of a trapezoid a wide end of which is located at said leading end.

9. In a radial piston machine of the type having a housing, a reciprocable piston in said housing and having an axial end portion, and a piston-reciprocatng element having a glide surface located opposite said end portion with one of said elements and piston being movable relative to the other in a manner resulting in the reciprocation of said piston, a combination comprising a glide shoe articulately connected to said end portion of said piston and having a glide face in gliding contact with said glide surface, said glide face being of substantially rectangular outline and having two spaced longitudinal edges and two spaced transverse edges which extend from one to the other of said longitudinal edges, said glide face being formed with a recess which communicates via a passage with a source of pressure fluid, a sealing rim of substantially constant width surrounding said recess, and a plurality of face portions which are located outwardly of said sealing rim and configurated so that hydrodynamic pressure fields develop between said face portions and the respectively juxtaposed surface portions of said glide surface, said recess being centered on the center of said glide face and having a trapezoidal outline provided with a narrow end which faces one of said transverse edges which is a leading edge with respect to the relative movement of said shoe and element; two of said face portions being triangular and each extending along one of said longitudinal edges and having a wide side located at said leading edge, each of said face portions being separated from said rim by a groove extending rearwardly from said leading edge; and said face portions including a pair of rectangular face portions extending from the other of said transverse edges towards said one transverse edge having a major dimension extending intermediate said transverse edges, said rectangular face portions being separated by an additional groove extending from said other transverse edge towards said rim and having two portions extending in the region of said rim to said longitudinal edges intermediate said rim and said rectangular face portions.

* * * * *